US006361852B1

(12) United States Patent
Gu et al.

(10) Patent No.: US 6,361,852 B1
(45) Date of Patent: Mar. 26, 2002

(54) INK-JET PRINTABLE MATERIAL FOR THERMAL TRANSFER

(75) Inventors: Jiren Gu, Naperville, IL (US); David Hulse, Baldwinsville; Bruce A. J. McKee, Liverpool, both of NY (US)

(73) Assignee: Felix Schoeller Technical Papers, Inc., Pulaski, NY (US)

( * ) Notice: Subject to any disclaimer, the term of this patent is extended or adjusted under 35 U.S.C. 154(b) by 0 days.

(21) Appl. No.: 09/401,706

(22) Filed: Sep. 23, 1999

(51) Int. Cl.[7] ..... B41M 5/00

(52) U.S. Cl. ..... 428/195; 428/211; 428/331; 428/500; 428/914

(58) Field of Search ..... 428/195, 913, 428/914, 331, 211, 411.1, 500; 156/235

(56) References Cited

FOREIGN PATENT DOCUMENTS

EP 0 805 049 A1 * 11/1997 ..... 428/195

* cited by examiner

*Primary Examiner*—Bruce H. Hess
(74) *Attorney, Agent, or Firm*—Cook, Alex, McFarron, Manzo, Cummings & Mehler, Ltd.

(57) ABSTRACT

A printable image transfer material comprising a support, an intermediate release layer on said support, and an image receiving layer, wherein said release layer contains a thermoplastic polymer with a surface tension of about 15 to 30 dyn/cm.

13 Claims, No Drawings

INK-JET PRINTABLE MATERIAL FOR THERMAL TRANSFER

BACKGROUND OF THE INVENTION

The invention concerns a printable image support material for thermal image transfer onto flat porous surfaces, especially an ink-jet printable thermal transfer paper.

There are various methods to transfer individual, personal images or designs onto textiles. These designs are printed on release paper or transfer paper using various printing methods such as the thermal dye diffusion transfer process (D2T2), the ink-jet printing method or the toner procedure (electrophotography) and then transferred by heat or pressure to the textile material while the paper backing is removed.

One of these procedures is described in DE 26 53 654 A1, which discloses the creation of long-life, xerographically produced images on cloth. A silicon-coated sheet with a coating layer on top is produced on which the image will be created xerographically. A disadvantage of the transfer paper with silicon coating is that the silicon residue remains on the fibres of the textile backing during the release process after the image is transferred.

U.S. Pat. No. 5,501,902 teaches a printable paper is presented which contains a first polymer layer and an ink-jet printable second layer with film-forming binder, a fine-grained thermoplastic polymer and ink viscosity modifying agent. The images transferred to the textile surface with the help of this transfer paper under the influence of heat and pressure exhibit a high color density while the polymer layer laminate transferred with the images adheres very well to the textile surface. A disadvantage of the transfer paper is that the viscosity-modifying agent usually used is a hydrophilic agent such as polyethylene glycol or polyvinyl alcohol. This agent has a positive effect on the binding ability, however it has a negative effect on the wash fastness due to its water solubility.

DE 299 02 145 U describes a transfer paper which comprises a color receiving layer containing a finely particulate organic pigment and silica. Silica has a favorable effect on the color density. However, silica can only be added in a limited amount. At an amount of more than 15 wt. % transfer problems exist. The organic pigment melts at high temperature and forms a film. But the film is weakened if a large amount of silica is included in the film. The image transfer with such films is difficult.

In addition the ink-jet papers mentioned above are hot peel products. However, if the size of a printed image increases, it becomes difficult to keep the entire image before peeling the support off the textile. The textile may become yellowish as a result of long time heating at high temperature. Furthermore, the image transfer is not complete and the image quality is adversely affected.

SUMMARY OF THE INVENTION

It is therefore an object of the present invention to provide an improved image transfer material which does not show the above-mentioned disadvantages. In particular, the improved image transfer material shall allow the image on the textile material to be separated without heating, e.g. at room temperature, and shall satisfy the requirement of providing high ink absorption, that after having been transferred to a textile material still presents excellent optical qualities, in particular high color density, and which, on a textile material, shows high fastness to washing.

These objects are achieved by a printable image transfer material which comprises a support, an intermediate release layer containing a thermoplastic polymer with a surface tension of about 15 to 30 dyn/cm, and an image receiving layer.

The aforementioned objects are also achieved with a printable image transfer material comprising a support, a first layer overlaying the front side of the support material, said first layer containing a thermoplastic polymer with a surface tension of about 15 to 30 dyn/cm, a second layer overlaying the first layer, said second layer containing a polymer having a melt index of between 2 and 10 (ASTM D 1238), and an image receiving layer overlaying the second layer, said receiving layer containing a water dispersible binder, a finely particulate organic pigment, and silica.

DETAILED DESCRIPTION OF THE PREFERRED EMBODIMENT

In a preferred embodiment of the invention the thermoplastic polymer in the release layer is a polyalkyl alkylene wherein the alkyl is an alkyl with 1 to 4 carbon atoms and the alkylene is an alkylene with 3 to 7 carbon atoms. Particularly preferred as an polyalkyl alkylene is polymethylpentene. The release layer is applied using extrusion coating technology in an amount of 5 to 30 g/m$^2$, in particular 15 to 26 g/m$^2$. Preferably, the surface tension of the thermoplastic polymer is from 15 to 25 dyn/cm. The surface tension may be determined according to the TAPPI method T552 p m-92.

The image receiving layer contains a water dispersible binder, in particular a polymer with low film forming temperature such as an acrylic acid ester copolymer, vinyl acetate homopolymer or copolymer, a styrene/butadiene-latex or an acrylnitrile/butadiene-latex. In a preferred embodiment of the invention the binder amount is less than 15 wt. % of total coating weight percentage.

The fine-grained organic pigment is preferably a thermoplastic polymer selected from the group of polyolefines, polyester, vinyl acetate (co)polymers, cellulose ester or polyamides. Particular suited are polyamides with a mean particle size of up to 30 $\mu$m, especially 5 to 25 $\mu$m. Particularly favorable results were obtained with a fine-grained polyamide with a specific surface area of more than 4 m$^2$/g. The quantity of the fine-grained organic pigment is about 20 to 80 wt. %, especially 30 to 70 wt. %, based on the weight of the dried receiving layer.

The use of silica in the receiving layer results in a particularly high definition of the images transferred to the textile surface when compared with the materials known from the state of the art which do not comprise silica in the receiving layer. The amount of the silica in the receiving layer is about 5 to 40% by weight, especially about 15 to 35% by weight, based on the weight of the dried layer.

In one particular embodiment of the invention the receiving layer may contain a cationic dye fixing agent, e.g. a quaternary polyammonium salt, cationic polyamines, cationic polyacryl amides or cationic polyethylene imines. The amount of the dye-fixing agent can be up to about 5% by weight.

The image receiving layer can be applied to the support material from an aqueous coating solution. Any conventional application and dosing method can be used for this purpose. The application weight of the receiving layer may vary from 5 to 20 g/m$^2$, particularly from about 8 to 15 g/m$^2$.

The receiving layer can be applied to the release layer (first layer), either directly or over the second layer. In a special embodiment of the invention the image support material additionally comprises a second layer overlying the first layer, which second layer contains a polymer having a melt index of between 10 and 300, preferably of 100 to 250, (in accordance with ASTM D 1238). The second layer preferably contains an ethylene copolymer or an ethylene copolymer mixture. The ethylene copolymer can in particular be an ethylene/vinyl acetate and/or an ethylene/(meth) acrylic acid alkyl ester copolymer. The second layer is applied to the first layer using an extrusion coating system. The application weight of the second layer can be from 10 to 50 g/m$^2$, and in particular from about 30 to 40 g/m$^2$.

The support material is usually any flexible sheet material such as plastic films, uncoated or surface-modified papers, nonwoven and woven webs, foils and the like. Particularly suitable is a paper with very low sizing and an open surface structure. In a preferred embodiment of the invention the paper used as the support material has a sizing degree of more than about 40 mg/100 cm$^2$ and an air permeability of 5 to 500 sec Gurley, preferably 10 to 50 sec Gurley. Suitable pulps for the manufacture of a paper support are, for example, mixtures of hardwood and softwood pulp. Suitable hardwood pulps, for example, are mixtures of beech, birch, and/or eucalyptus wood pulps. Suitable softwood pulp, for example, is a pine wood pulp.

Any design can be printed on the surface of the image support material with the aid of various printing processes and in particular ink-jet printing. The designs can then be transferred to any synthetic or natural fabric or other flat objects. The image transfer material printed with the designs is then brought into contact with a flat backing. The transfer occurs under heat (130–200° C.) and pressure (0,13×10$^4$ to 50.0×10$^4$ N/m$^2$). Then the support material is removed from the backing.

The following examples serve to explain the invention in more detail.

EXAMPLES

A mixture of 60 wt. % of bleached hardwood sulphate pulp and 40 wt. % of bleached pine wood pulp, was beaten to a degree of freeness of 35° SR. The sizing agents described below were then added to the pulp suspension and a base paper with a basis weight of about 110 g/m$^2$ was made. The paper was surface-sized in the known manner with an aqueous solution, which contains 2.5 wt. % modified starch and 1 wt. % of NaCl. Sizing agents were about 0.40 wt. % cationic starch and about 0.40 wt. % of an alkyl ketene dimer. Both percentages are based on the weight of the fiber material.

After a corona pre-treatment, the front side of the above-mentioned paper was extrusion-coated with polymethylpentene (DX820M from Mitsui) in an amount of 24 g/m$^2$ by means of a 2" extruder, maintaining a temperature profile from feeder to die of 316, 343, 316, 304 and 304° C. The screw line speed was 75 fpm. To achieve a high gloss product a high-gloss chill roll was used. In a further step the ethylene/acrylic acid (Primacore® 5980 from Dow Chemicals) was extrusion coated on the polymethylpentene layer in an amount of 30 g/m$^2$ by means of a 2" extruder (temperature set-up from feeder to die: 135, 149, 149, 149, 149° C.) at a line speed of 75 fpm. An ink-receiving layer was then applied to the ethylene/acrylic acid layer which composition is shown in the table 1 below. The coating weight was 15 g/m$^2$.

TABLE 1

| Composition | 1a | 1b |
|---|---|---|
| Polyamide (Orgasol ® 3501, supplied by Elf (Atochem) | 24 g | 24 g |
| Precipitated silica (Gasil ® HP39, supplied by Crossfield) | 6 g | 12 g |
| Styrene/butadiene latex (Styronal ® 4202, supplied by BASF) | 6 g | 6 g |
| amino-modified p-toluene sulphonic acid (Cycat ® 4504, supplied by Cycat) | 1.5 g | 1.5 g |
| Grind aid (Surfynol ® CT-171, supplied by air products) | 1 g | 1 g |
| Surfactant (Triton ® X-100, Union Carbide) | 0.1 g | 0.1 g |
| Isopropanol | 30 g | 30 g |
| Deionized water | 70 g | 70 g |

Comparative Examples

A base paper with a basis weight of 96 g/m$^2$ provided with a usual silicon layer was extrusion-coated with ethylene/vinyl acetate in an amount of 30 g/m$^2$ and coated with an aqueous solution, the compositions of which in the dry state are shown in table 2.

TABLE 2

| Components | V1 | V2 |
|---|---|---|
| Fine-grained polyamide | 38.0% | 75.0% |
| Silica | 15.0% | — |
| Polyacrylate | — | 20.0% |
| Polyvinyl alcohol | 34.0% | — |
| Cationic dye fixing polymer | — | 5.0% |
| Dispersing agent | 2.0% | — |
| Softening agent (sulphonamide) | 11.0% | — |
| Coating weight, g/m$^2$ | 10 | 10 |

The % values in the table are based on the total weight of the coating composition.

Test Results

The papers created in the examples were provided with a test image (for the basic colors of yellow, cyan blue, magenta red and black) using a HP 690 ink jet printer at 720 dpi mode. The printed paper was then placed in contact with a textile backing (fabric made of 100% cotton) in a press in which the image was transferred to the backing by heat (182° C.) and pressure (34.5×10$^4$ N/m$^2$). The transfer paper is peeled off the textile backing after cooling down to room temperature. The separation took place at the release coating. Excellent transfer properties were observed in the case of papers according to the invention.

In another testing step, the printed textile backing was washed with conventional washing agents at 30° C. and dried. Subsequently, the color density of the printed textile backing was measured. The measurements were made before and after washing step using a type 186 D Gretag densitometer for the basic colors. An average color density was calculated from the density values for the individual colors. The results are shown in table 3.

TABLE 3

| | Color density | | peeling |
|---|---|---|---|
| Example | prior to washing | after washing | properties at room temp. |
| 1 | 1.90 | 1.52 | excellent |
| 2 | 1.92 | 1.40 | excellent |

TABLE 3-continued

| Example | Color density prior to washing | Color density after washing | peeling properties at room temp. |
|---|---|---|---|
| V1 | 1.75 | 1.14 | poor |
| V2 | 1.65 | 0.95 | poor |

The evaluation of the color density of samples according to the invention shows a clear improvement in comparison with the products available on the market. The images on the textile backing created with the aid of the invention image transfer material have higher color densities, and they have a lower loss of color density after washing. A loss of color density of more than 35% after washing is not acceptable.

What we claim is:

1. A printable image transfer material comprising a support, an intermediate release layer on said support, and an image receiving layer, wherein said release layer contains a thermoplastic polymer with a surface tension of about 15 to 30 dyn/cm, wherein the thermoplastic polymer is a polyalkyl alkylene, and wherein the alkyl is an alkyl with 1 to 4 carbon atoms and the alkylene is an alkylene with 3 to 7 carbon atoms.

2. The image transfer material according to claim 1, wherein said release layer contains polymethylpentene.

3. The image transfer material according to claim 1, wherein the release layer has a coating weight of about 5 to 30 $g/m^2$.

4. The image transfer material according to claim 1, wherein said support is a paper base with a Cobb value of more than about 40 $mg/100\ cm^2$ and an air permeability of about 10 to 50 s Gurley.

5. The image transfer material according to claim 1, wherein said receiving layer contains a latex binder, a fine-grained organic pigment and silica.

6. The image transfer material according to claim 5, wherein the fine-grained organic pigment is contained in the receiving layer in an amount of from 20 to 80 wt. % based on the weight of the dried layer.

7. The image transport material according to claim 5, wherein the silica is contained in an amount of from about 5 to 40 wt. % based on the weight of the dried layer.

8. A printable image transfer material comprising a support having a front side, a first layer overlaying the front side of the support, said first layer containing a thermoplastic polymer with a surface tension of about 15 to 30 dyn/cm, wherein the thermoplastic polymer is a polyalkyl alkylene, and wherein the alkyl is an alkyl with 1 to 4 carbon atoms and the alkylene is an alkylene with 3 to 7 carbon atoms, a second layer overlaying the first layer, said second layer containing a polymer having a melt index of between 10 and 300 (ASTM D 1238), and an image receiving layer overlaying the second layer, said receiving layer containing a water dispersible binder, a finely particulate organic pigment and silica.

9. The image transfer material according to claim 8, wherein the first layer contains polymethylpentene.

10. The image transfer material according to claim 8, wherein the second layer contains an ethylene/acrylic acid copolymer and/or ethylene/vinyl acetate copolymer.

11. The image transfer material according to claim 8, wherein the finely particulate organic pigment is selected from the group consisting of polyolefines, polyesters, polyamides, cellulose ester or vinyl acetate polymers.

12. The image transfer material according to claim 8, wherein the water dispersible binder is selected from the group consisting of an acrylic acid ester polymer, a vinyl acetate homopolymer or copolymer, a styrene/butadiene-latex or an acryl nitrile/butadiene-latex.

13. The image transfer material according to claim 8, wherein the content of silica in the receiving layer is from 5 to 40 wt. %, based on the weight of the dried layer.

* * * * *